United States Patent [19]

Pfarrwaller et al.

[11] Patent Number: 4,922,967

[45] Date of Patent: May 8, 1990

[54] FIRING DEVICE FOR A PROJECTILE WEAVING MACHINE AND PROJECTILE THEREFOR

[75] Inventors: Erwin Pfarrwaller, Winterthur; Danilo Vezzu, Seuzach, both of Switzerland; Oskar Hubner, Radolfzell, Fed. Rep. of Germany

[73] Assignee: Sulzer Brothers Limited, Winterthur, Switzerland

[21] Appl. No.: 319,650

[22] Filed: Mar. 6, 1989

[30] Foreign Application Priority Data

Mar. 14, 1988 [CH] Switzerland ..... 950/88

[51] Int. Cl.[5] ..... D03D 49/32

[52] U.S. Cl. ..... 139/145

[58] Field of Search ..... 139/142, 144, 145–146, 139/196.1, 196.2, 196.3

[56] References Cited

U.S. PATENT DOCUMENTS 2,160,338 5/1939 Moessinger ..... 139/145
2,739,620 3/1956 Selles ..... 139/145

FOREIGN PATENT DOCUMENTS 631159 6/1936 Fed. Rep. of Germany ..... 139/142
1098802 1/1968 United Kingdom .

*Primary Examiner*—Henry S. Jaudon
*Attorney, Agent, or Firm*—Kenyon & Kenyon

[57] ABSTRACT

The torsion bar firing device is provided with a striking lever having an end piece at the distal end which acts directly on the abutment face of a projectile on firing. The striking face of the end piece of the striking lever and/or the abutment face of a projectile may be formed as inclined planes or as convex, concave, or concave-convex surfaces. The direct drive of the projectile by the striking lever reduces the masses to be accelerated and braked. This advantageously influences the energy consumption and the weaving efficiency of the projectile weaving loom. The end piece may be integral with the distal end of the striking lever or may be in the form of a rotatably mounted roller of a trapezium shaped element.

15 Claims, 5 Drawing Sheets

Fig. 6A
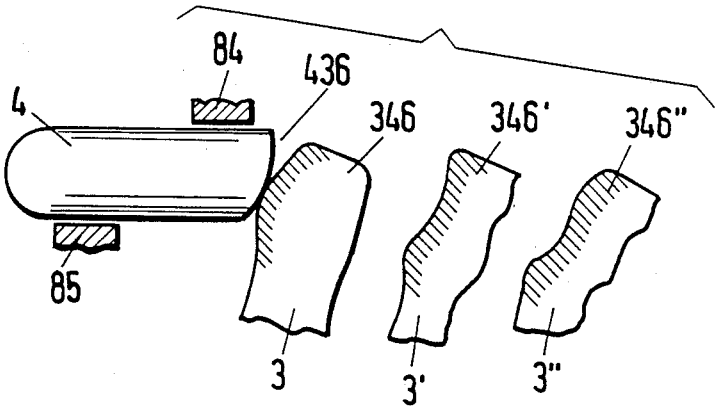
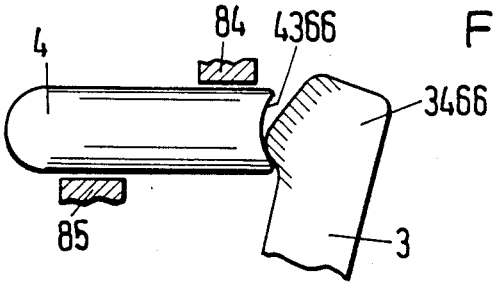
Fig. 6B
Fig. 7
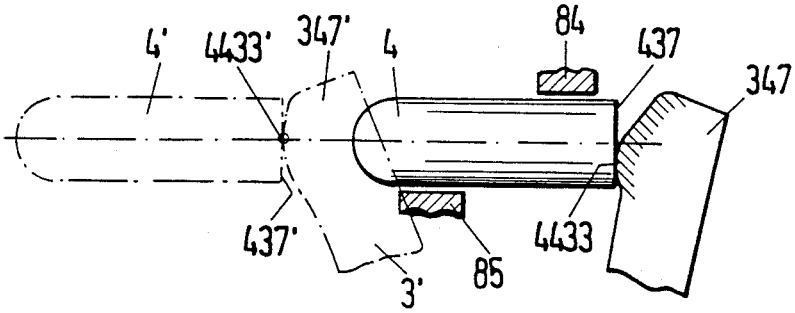

FIRING DEVICE FOR A PROJECTILE WEAVING MACHINE AND PROJECTILE THEREFOR

This invention relates to a firing device for a projectile weaving machine as well as a projectile therefor.

Heretofore, it has been known to provide projectile weaving machines with a firing device for the picking of a projectile into and through a shed of warp yarns. For example, various types of firing devices have been known, such as described in European Patent Application No. 0152826; U.S. Pat. No. 4,223,703; Swiss Pat. No. 636,655 and French Pat. No. 1,089,664. Typically, the construction of the firing devices is as described in European Patent Application No. 0152826 wherein a projectile is fired and accelerated by a striking piece, known as an accelerator guide piece, which is guided in a straight guideway in the firing direction of the projectile. The striking piece, is, in turn, connected by a link such as an abutment link or traction link, to a striking lever which is pivotally mounted about a transverse axis. During operation, the striking lever is pivoted with the rotary movement of the lever being transferred through the connecting link into a linear movement of the guided striking piece. The striking piece, in turn, has a striking face which impacts against the rear end of a projectile in order to accelerate the projectile within a few milliseconds over a path of a few centimeters to velocities of up to 50 meters per second and more. After the acceleration phase, the striking piece, striking lever and connecting link are braked over a short path of only a few centimeters. Where a torsion bar is used to pivot the striking lever, the rotary movement of the torsion bar is also braked through a small rotary angle.

With present-day projectile weaving machines which are built for high speed operation and with increasing weft insertion frequency, there always remains less time for the acceleration of the projectile so that increasingly greater performance is necessary, e.g. with torsion bars which have higher torsion moments. Correspondingly, increasingly greater braking performance is necessary for braking the rotary movement of the torsion bar with the striking lever and for causing the movement of the striking piece and connecting link.

However, in the known firing devices, the conversion of the rotary movement of the striking lever, through the connecting link, into the linear movement of the striking piece and also of the projectile, limits and restricts the range of rotation of the striking lever and of the torsion bar. Although a multi-part construction, particularly of the connecting link, would permit this path to be made longer, the masses to be accelerated and then braked would be increased, so that the required driving and braking power would be still higher.

With the present day achieved performance level of high performance projectile weaving machines, and with a fixedly predetermined rotation range, it is hardly possible to extend, for example, the acceleration path for the projectile, at the expense of the braking range, or vice versa, without the weft insertion system, and more particularly the firing device, requiring an uneconomically high amount of energy. Further, the braking power required to be applied to the torsion bar and associated striking lever, striking piece and connecting link would necessitate wasteful and expensive constructions.

Accordingly, it is an object of the invention to increase the drive power delivered to a projectile for picking without increasing the total power of a firing device.

It is another object of the invention to provide a firing device for a projectile weaving machine which is capable of high speed operation.

It is another object of the invention to increase the power of a firing device for a projectile weaving machine.

Briefly, the invention provides a firing device for a projectile weaving machine which comprises a torsion bar disposed for twisting about a longitudinal axis thereof, means for twisting the torsion bar about the axis, a striking lever connected to and extending transversely from the torsion bar for pivoting about the axis of the bar during twisting of the torsion bar and an end piece at a distal end of the lever for movement in a circular path for striking and accelerating a projectile from a firing position.

The projectile to be used with the firing device has a housing defining a hollow body with a partial closed rear end facing the end piece of the firing device. In addition, the rear end of the projectile has a surface which is matched to that of the striking surface of the end piece. For example, the rear of the projectile has a surface which is selected from one of an inclined plane surface, a convex surface, a concave surface and a concave-convex surface while the end piece of the firing device has a striking face of a shape selected from a flat shape, a convex shape, a concave shape and a concave-convex shape.

In one embodiment, the end piece is rotatably mounted on the striking lever and is in the form of a rotatably mounted roller or is of polygonal shape with a plurality of faces for striking a projectile.

In another embodiment, the end piece has a striking surface for striking a projectile which is in the shape of a toothed wheel segment while the projectile rear end has a surface which is formed with matching teeth. In this construction, the rear end of the projectile is approximately like the flanks of teeth of a toothed wheel or a toothed rack.

The projectile may also be made with two abutment faces at the rear end which are symmetrically arranged.

The firing device is constructed without a connecting link and a striking piece as compared to previously known constructions. This leads to a considerable reduction in the moved masses which have to be accelerated and then braked. Moreover, the firing device allows the acceleration path of the projectile and the braking path for the rotary movement of the torsion bar and striking lever to be made longer than theretofore. This allows the use of torsion bars with lower torsion movements and also the use of lower power braking devices for braking the rotary movement of the torsion bar and striking lever for the same or even for higher firing frequencies.

These and other object and advantages of the invention will become more apparent from the following detailed description taken in conjunction with the accompanying drawings wherein:

FIG. 1 diagrammatically illustrates a firing device incorporated in a projectile weaving machine in accordance with the invention;

FIG. 6A illustrates a projectile having a convexly shaped rear abutment face suitable for cooperating with an end piece of a firing device having three possible forms of striking faces;

FIG. 6B illustrates a further modified arrangement of matching abutment surfaces of a projectile end piece in accordance with the invention; and FIG. 7 illustrates an end piece and projectile in a firing position and a fired position in accordance with the invention.

Figure 1:
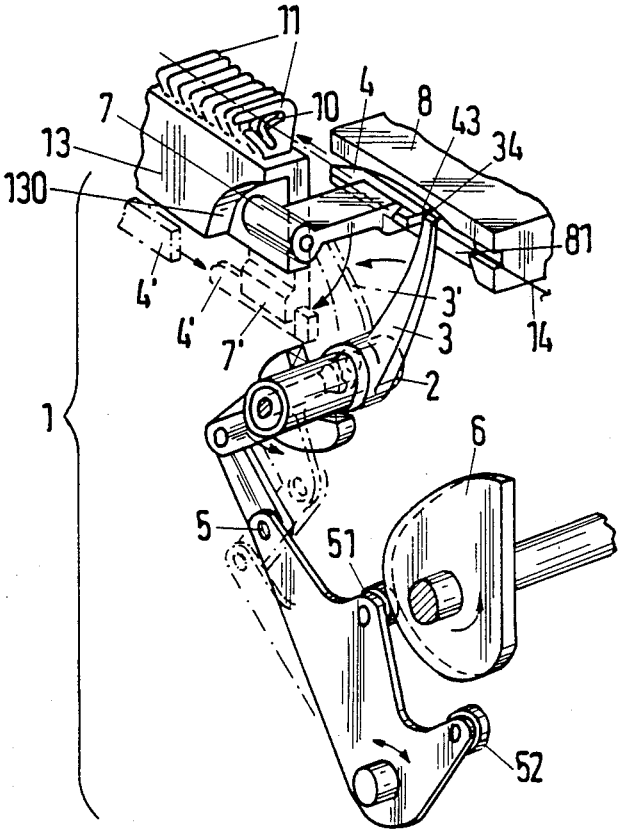

Referring to FIG. 1, the projectile firing device 1 is constructed for use with a projectile weaving machine (not shown in detail). As illustrated, the firing device 1 employs a torsion bar 2 which is disposed for twisting about a longitudinal axis thereof as well as a striking lever 3 which is connected to and which extends transversely from the torsion bar 2 for pivoting about the axis of the bar 2 during twisting of the torsion bar 2. An end piece 34, constructed as an accelerating finger, is disposed at the distal end of the lever 3 for striking and accelerating a projectile 4 from a firing position. As indicated, the end piece 34 is integral with the striking lever 3.

The torsion bar 2 is fixedly mounted at one end (not shown) and is connected with a means such as a knee joint 5 for the twisting of the torsion bar 2 about the longitudinal axis thereof. As shown, the knee joint 5 is movable under the influence of a cam plate 6 against which a roller 51 of the knee joint 5 is spring biased in a manner not shown. As illustrated, the rotating cam plate 6 brings the knee joint 5 into the extended position shown in full lines in FIG. 1 via the roller 51. In this way, the torsion bar 2 is twisted and torsionally loaded while the striking lever 3 is brought into a firing position.

Firing of a projectile 4 occurs when a part of the cam surface of the cam plate 6 is on a roller 52 of the knee joint 5 in such a way that the knee joint 5 is unstraightened and relaxed. At this time, the torsion bar 2 with the striking lever 3 is rapidly returned to the unloaded position thereby firing and accelerating the projectile 4. The relaxed knee joint 5' and accelerated striking lever 3' are partially shown in broken lines in FIG. 1.

As illustrated in FIG. 1, the end piece 34 of the striking lever 3 acts on an abutment face 43 at the rear end of a projectile 4 at the time of firing causing the projectile 4 to be fired through a shed of warp yarns in a passage 10 formed by guide teeth 11 within the weaving machine. As indicated, the guide teeth 11 are mounted on a sley member 13 in known manner.

The projectiles 4 are successively moved into the firing position by means of a pivotally mounted projectile lifter 7. As indicated by broken lines, the projectile lifter 7' moves a projectile 4' into a striking position in front of the end piece 34 on the striking lever 3. As with known projectile 4' to the projectile lift 7' is effected by way of a transport chain (not shown).

A guide beam 8 is provided for guiding the projectile 4 when fired from the firing position. As indicated, the guide beam 8 is provided with suitable guide slots to accommodate the projectile 4 as well as a weft yarn 14 which is gripped in and which trails from the projectile 4. In addition, a wall 81 of the guide beam is recessed and shaped so as to accommodate the circular movement of the end piece 34 during picking. Likewise, the sley member 13 is provided with a recess 130 to accommodate the swinging movement of the end piece 34 and striking lever 3.

The drive of the projectile lifter 7 takes place in known manner, for example by means of a shaft (not shown) on which the lifter 7 is rotationally fixedly mounted. During the swinging movement of the projectile lifter 7, the projectile 4 is held fast, for example, by a gripper (not shown) which engages in an opening of a projectile 4 between two arms of a thread clamp of the projectile 4. This gripper can simultaneously ensure the exact positioning of the projectile 4 for firing.

Referring to FIG. *2a*, the striking face of the end piece 34 of the striking lever 3 abuts the rear abutment face 43 of the projectile 4 in the firing position. In this embodiment, the end piece 34 is a metal piece fixed on the distal end of the striking lever 3 with a striking face adapted to the abutment face 43 of the projectile such that on firing, the surfaces roll on each other, for example, like the flanks of toothed wheels or like the teeth of a toothed wheel and the teeth of a toothed rack. Conceivably, the end piece may be made as a hardened part of the striking lever. Two further positions of the striking lever are shown as 3' and 3'' while the reversing position is shown as 3''' in broken lines.

The firing phase of the firing device is partially complete after the striking lever has completed a rotation through an angle $\alpha$. Thereafter, the projectile 4 begins to separate from the end piece 34 while the striking lever 3 rotates through a further angle $\beta$ and is braked as far as the reversing position 3'''. The braking region of the striking lever 3 extends through the recess 130 in the sley member 13.

Figure 2A:
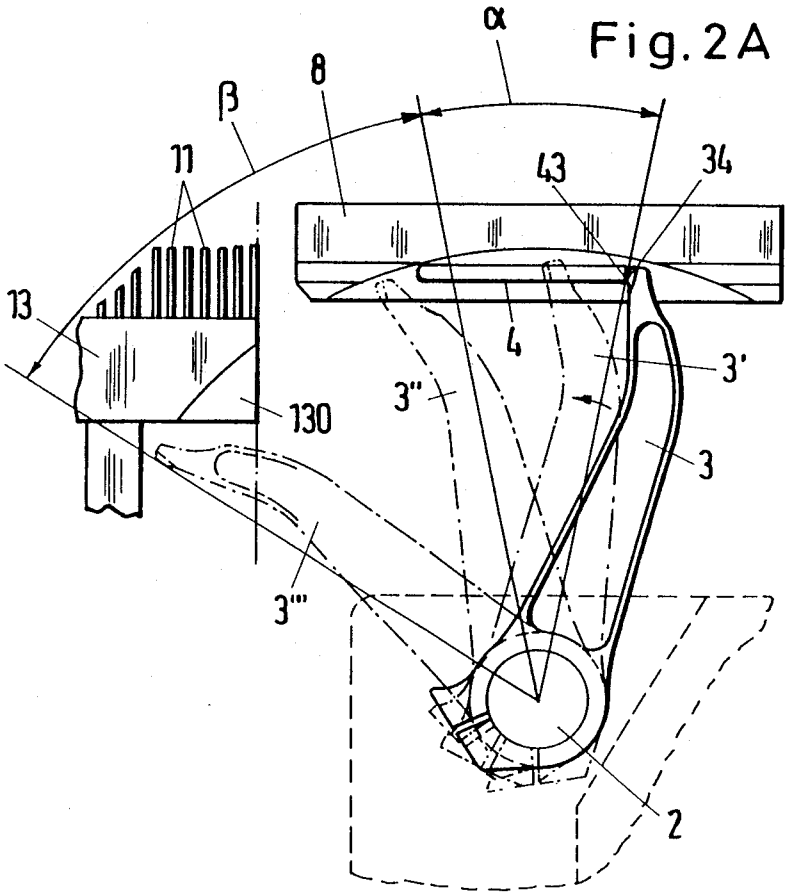
FIG. 2A illustrates a side view of a firing device in various positions during operation.
Figure 2B:
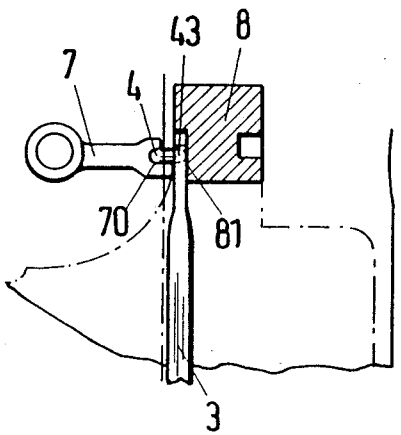
FIG. 2B illustrates a part-cross sectional view of the firing device of FIG. 2A.

Referring to FIG. 2B, the projectile 4 is guided within a recess 70 of the projectile lifter 7 and the wall 81 of the guide beam 8 during firing. As illustrated, the abutment face of the projectile 4 is laterally spaced from the central axis of the projectile. This is necessary because the striking lever 3 moves outside the swinging range of the projectile lifter 7 and the weft thread 14 to be introduced extends within the mid plane of the projectile 4. With projectile weaving machines where the projectile 4 is rotated through 180° about the longitudinal axis in successive weft insertions, two symmetrically arranged abutment faces 43 are provided at the rear end of the projectiles.

As indicated in FIG. 2A, the braking of the striking lever 3 occurs over a relatively great rotary angle relative to the striking angle since the freedom of movement of the striking lever 3 is no longer restricted by a linearly moved striking piece, for example an abutment link connected to the striking lever.

Where the end piece 34 is fixed on the striking lever 3 any suitable means may be provided for securing the end piece 34 on the striking lever 3.

Figure 3B:
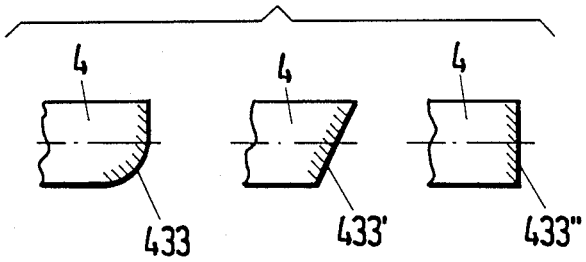
FIG. 3B illustrates three possible forms of abutment faces on the rear end of a projectile for cooperation with a firing device as illustrated in FIG. 3A.
Figure 3A:
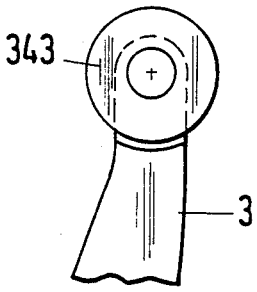
FIG. 3A illustrates a partial view of a firing device employing a rotatably mounted roller in accordance with the invention.

Referring to FIG. 3A, the striking lever 3 may be provided with an end piece which is rotatably mounted thereon, for example, a rotatably mounted roller 343.

Referring to FIG. 3B, the rear end of a projectile 4 may have various surfaces matched to the striking face of the end piece of a striking lever 3. Three possible embodiments are illustrated, for example, the rear end of the projectile may have a surface in the form of a convex surface 433 relative to the flight direction, a flat inclined plane surface 433' which is oblique to the flight direction and a flat abutment face 433" which is perpendicular to the direction of flight. The abutment faces 433', 433" may also be inclined planes and/or the abutment faces may extend as mirror images to those shown by 433, 433'.

The end piece of the striking lever may alternatively be constructed as a rotatable polygon, such as a hexagonal polygon, with a plurality of faces for successively abutting the striking faces.

In order to mount the end piece on the striking lever, use may be made of needle bearings since such bearings facilitate the easy rotation and positioning of the end piece.

Figure 4B:
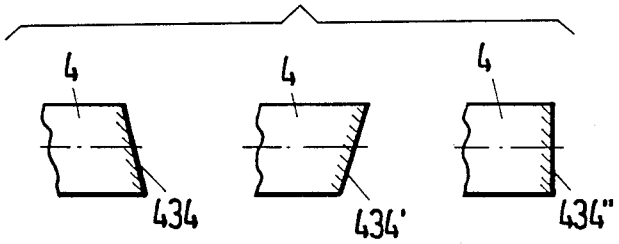
FIG. 4B illustrates three possible forms of abutment surfaces of a projectile for cooperating with an end piece as illustrated in FIG. 4A.
Figure 4A:
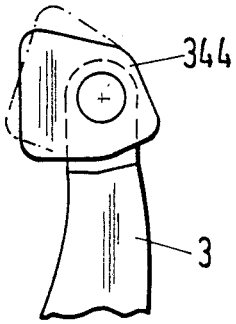
FIG. 4A illustrates a modified firing device employing a further modified end piece in accordance with the invention.

Referring to FIG. 4A, the end piece of the striking lever 3 may be in the shape of a trapezium body 344 which is swingably mounted on an axle. A second position of this end piece is shown in broken lines.

Referring to FIG. 4B, the rear end of the projectile 4 may be provided with three variations to cooperate with the end piece 344 shown in FIG. 4A. In this case, the abutment surface is flat but may be disposed so that the faces 434, 434' are inclined to the flight direction or with the face 434" perpendicular to the flight direction. In this construction, the angular position of the end piece 344 continuously changes during firing in such a way that the abutment faces 434, 434', 434" and the striking face of the end piece 344 engaging thereon are in constant contact and remain in constant matching contact with each other during pivoting of the lever 3 over a predetermined angle.

Figure 5A:
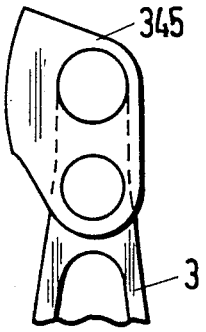
FIG. 5A illustrates a further modified end piece in accordance with the invention.
Figure 5B:
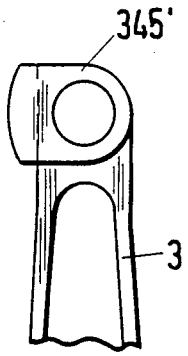
FIG. 5B illustrates a further modified end piece in accordance with the invention.
Figure 5C:
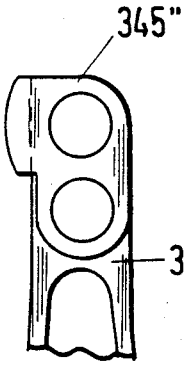
FIG. 5C illustrates a still further modified end piece constructed in accordance with the invention.

Referring to FIGS. 5A, 5B, and 5C, the abutment face and/or striking faces of the end piece may be of arched construction. As illustrated, the three end pieces 345, 345', 345" have convex striking faces and are mounted at the distal end of a striking lever, for example by screws so as to be easily replaceable.

Referring to FIG. 6A, a projectile 4 may be provided with a convex abutment face 436 to cooperate with three possible shapes of end pieces, 346, 346', 346". Depending on the desired striking or acceleration characteristic, projectiles with the illustrated abutment face 436 can be used with an end piece having a convex striking face 346 or with an end having a convex-concave striking face 346', 346". As diagrammatically illustrated, guide elements 84, 85 are provided for holding and guiding the projectile 4 in a correct firing path during the acceleration phase. Even there, the abutment face of the projectile and the striking face of the end piece may be matched to each other so that, on firing, they roll on each other as the flanks of toothed wheels or like flanks of a toothed wheel and a toothed rack. With such a construction, projectile and end piece slide on each other or make contact according to the laws of tooth meshing, usually along a line, the so-called engagement line or contact line.

Referring to FIG. 6B, a projectile 4 may be provided with a concave abutment face 4366 while the end piece 3466 has a convex striking face while being mounted on a striking lever 3.

Referring to FIG. 7, which diagrammatically illustrates the details of the engagement of an end piece 347 and a projectile 4 at the beginning or during, and at the end of the acceleration phase. In this embodiment, the end piece 347 has a concavely arched inclined face which rolls on a flat abutment face 437 of a projectile 4. As indicated, the abutment face is perpendicular to the weft direction. The projectile 4 and end piece 347 contact each other always on a line, i.e. the engagement line 4433 or 4433'. In this embodiment, the engagement line is displaced toward the plane of symmetry of the projectile 4 during the course of the firing phase. Advantageously, the line of engagement at the timepoint of the end of the acceleration phase is in this plane of symmetry. Hence, the projectile 4, as far as possible, experiences no transverse forces. This favors the optimum flight of the projectile 4 through the guide passage.

The mutual positions of the projectile 4' and end piece 347' which contact in the line of engagement 4433' are shown in broken lines in FIG. 7. The projectile 4' separates from the end piece 347 precisely at this timepoint. The guide elements 84, 85 which are shown diagrammatically serve to hold and guide the projectile 4 in the correct firing path during the acceleration phase.

The materials used for an end piece and an projectile may be chosen, for example, to ensure a minimum wear of the abutment face of the projectile on firing as well as with an acceptable wear of the striking face of the end piece. Alternatively, the materials may be chosen to provide a minimum wear of the striking face of the end piece while accepting an acceptable wear of the abutment face of the abutment face of the projectile. For example, striking pieces of hard metal, hardened metal or of ceramics may be suitable. It is also conceivable to manufacture only the striking face or the striking faces from this particular material. Exchangeable or fixed end pieces of a material with special impact and striking characteristics enable the production of striking levers from material, with, for example, optimum strength characteristic with lowest mass of the lever.

The invention thus provides a firing device for a projectile weaving machine which is able to deliver a relatively high power driving force without the need for components of high mass.

The invention further provides a firing device wherein the striking face of an end piece of a striking lever remains in matching contact with a projectile surface during pivoting of the lever over a predetermined angle in order to accelerate the projectile to a picking speed.

The invention further provides a firing device which can be used on high speed projectile weaving machine without increasing the overall energy consumption of the machine while increasing the weaving efficiency of the machine.

What is claimed is:

1. A firing device for a projectile weaving machine comprising a torsion bar disposed for twisting about a longitudinal axis thereof;

means for twisting said torsion bar about said axis;

a striking lever connected to and extending transversely from said torsion bar for pivoting about said axis during twisting of said torsion bar; and an end piece at a distal end of said lever for striking and accelerating a projectile from a firing position thereof, said end piece being movable on a circular path and having a striking face for striking a rear face of a projectile and remaining in matching contact with the projectile while moving relative to the rear face of the projectile during pivoting of said lever over a predetermined angle.

2. A firing device as set forth in claim 1 wherein said end piece is integral with said striking lever.

3. A firing device as set forth in claim 1 which further comprises means for securing said end piece on said striking lever.

4. A firing device as set forth in claim 1 wherein said end piece is rotatably mounted on said striking lever.

5. A firing device as set forth in claim 4 wherein said end piece is a rotatably mounted roller.

6. A firing device as set forth in claim 4 wherein said end piece is of polygonal shape and has a plurality of faces for striking a projectile.

7. A firing device as set forth in claim 1 wherein said end piece has a striking face for striking a projectile of concave shape.

8. A firing device as set forth in claim 1 wherein said end piece has a striking face for striking a projectile of convex shape.

9. A firing device as set forth in claim 1 wherein said end piece has a striking face for striking a projectile of convex-concave shape.

10. In a weaving machine, the combination of a torsion bar disposed for twisting about a longitudinal axis thereof;

means for twisting said torsion bar about said axis;

a striking lever connected to and extending transversely from said torsion bar for pivoting about said axis during twisting of said torsion bar;

an end piece at a distal end of said lever for striking and accelerating a projectile from a firing position thereof, said end piece being movable on a circular path about said axis within the plane of said lever and having a striking face for striking a rear face of a projectile and remaining in matching contact with the projectile while moving relative to the rear face of the projectile during pivoting of said lever over a predetermined angle; and a guide beam for guiding a projectile from a firing position therein, said beam having a recessed wall shaped to accommodate a circular movement of said end piece therein during picking.

11. The combination as set forth in claim 10 wherein said end piece has a striking face for striking a projectile of and remaining in matching contact with the projectile during pivoting of said lever over a predetermined angle during picking.

12. In a weaving machine, the combination of at least one projectile for picking a weft yarn;

a transport device for positioning said projectile in a firing position; and a firing device including a torsion bar disposed for twisting about a longitudinal axis thereof, means for twisting said torsion bar about said axis, a striking lever connected to and extending transversely from said torsion bar for pivoting about said axis during twisting of said torsion bar, and an end piece at a distal end of said lever for movement in a circular path for striking and accelerating a projectile from said firing position thereof, said end piece having a striking face for striking a rear face of said projectile and remaining in matching contact with said projectile while moving relative to the rear face of said projectile during pivoting of said lever over a predetermined angle.

13. The combination as set forth in claim 12 wherein said projectile has a housing defining a body with a partial closed rear end facing said end piece of said firing device and defining said rear face.

14. The combination as set forth in claim 13 wherein said rear end of said projectile has a surface selected from one of an inclined plane surface, a convex surface, a concave surface and a concave-convex surface.

15. The combination as set forth in claim 13 wherein said end piece of said firing device has a face for striking said rear face of said projectile of a shape selected from a flat shape, a convex shape, a concave shape and a concave-convex shape.

* * * * *

UNITED STATES PATENT AND TRADEMARK OFFICE

CERTIFICATE OF CORRECTION

PATENT NO. : 4,922,967

DATED : May 8, 1990

INVENTOR(S) : Erwin Pfarrwaller, et al

It is certified that error appears in the above-identified patent and that said Letters Patent is hereby corrected as shown below:

Column 4, line 6, after "known" insert-projectile weaving machines, the return transport of the- Column 8, line 34, cancel "partial closed"

Signed and Sealed this

Fifth Day of November, 1991

*Attest:*

HARRY F. MANBECK, JR.

*Attesting Officer*

*Commissioner of Patents and Trademarks*